US005107916A

United States Patent [19]

van Roermund et al.

[11] Patent Number: 5,107,916

[45] Date of Patent: Apr. 28, 1992

[54] HEAT RESPONSIVE MEMORY METAL ACTUATOR

[75] Inventors: Ton van Roermund, Amsterdam; Ir P. Besselink, Enschede, both of Netherlands

[73] Assignee: I.P.S., b.v., Netherlands

[21] Appl. No.: 533,453

[22] Filed: Jun. 5, 1990

[51] Int. Cl.[5] ..... E05F 15/20

[52] U.S. Cl. ..... 160/6; 454/224

[58] Field of Search ..... 160/6; 98/40.25

[56] References Cited

U.S. PATENT DOCUMENTS 3,436,016 4/1969 Edwards .
4,497,241 2/1985 Ohkata .
4,567,549 1/1986 Lemme ..... 362/325 X

FOREIGN PATENT DOCUMENTS 490656 7/1975 Australia .
2148444 5/1985 United Kingdom .
2217451 10/1989 United Kingdom .

OTHER PUBLICATIONS

Patent Abstracts of Japan, vol. 13, No. 123, Mar. 27, 1989, JP-A-63 291 334 (Sumitomo Electric, Inc., Ltd. Nov. 29, 1988.

*Primary Examiner*—Blair M. Johnson
*Attorney, Agent, or Firm*—Marks Murase & White

[57] ABSTRACT

An actuator which includes a memory metal element, a substantially constant force counteracting spring, and an actuated element. The memory metal transforms from a martensite structure to an austenite structure at a known temperature. The martensite structure is more easily deformed than the austenite structure. The force applied by the counteracting spring is sufficient to deform the martensite structure throughout the transformation temperature range but insufficient to deform the austenite structure such that at least a portion of the memory metal element undergoes a predetermined stroke in response to the transformation of the memory metal element between the martensite and austenite states. The actuated element is connected to the memory metal element to move therewith.

20 Claims, 6 Drawing Sheets

HEAT RESPONSIVE MEMORY METAL ACTUATOR

FIELD OF THE INVENTION

The present invention relates to an actuator which automatically provides a motive force in response to heat. More specifically, the present invention relates to such an actuator which includes a memory metal component.

BACKGROUND OF THE INVENTION

Memory metal is an alloy (for example, an alloy of nickel and titanium) of particular near stoichiometric composition which has a memory of a particular stable shape. Memory metal has two structures, depending upon the temperature: the martensitic or cold structure and the austenitic or hot structure. For any given memory metal there is a temperature above which the metal has an austenitic structure and another, lower, temperature below which the metal has a martensitic structure. Between these two structures, there is a temperature area or range known as the transformation temperature range, in which the alloy is transformed. When heated, the alloy transforms from martensite (the "cold structure") to austenite (the "warm" structure). When cooled, the alloy transforms from austenite to martensite. These transformations take place with a certain hysteresis or lagging effect.

FIG. 1 is a stress strain curve for a memory metal. As shown in FIG. 1, when the memory metal is at a temperature below the transformation temperature range (TTR), the memory element has a martensitic structure and is easily deformed. Specifically, as shown in the stress-strain curve of FIG. 1, when a tensile force (F) is applied to the memory element at a temperature below the TTR, the strain increases linearly in area AB according to Hooks law, i.e., stress and strain are directly proportional. However, strain remains constant in the area BC as the metal deforms up to a maximum value of 8 percent. When the deformation force is removed, there remains an apparent plastic deformation, represented by AD. As shown in FIG. 1, the lengthening occurs in response to a relatively small force $F_3$ since the martensitic structure is easily deformed.

When the temperature is above the transformation temperature range (TTR), the memory element has an austenitic structure and it has stable dimensions (a conditioned shape). When a memory element deformed at a temperature beneath TTR is heated, it will return (i.e., shrink) to its conditioned shape or dimensions. The return to the stable shape takes place with a force that is considerably higher than the force needed to deform the memory element at a temperature beneath the TTR. This is apparent from FIG. 1 which shows that the tensile curve representing the recovery force $F_2$ (the "hot tensile curve") lies much higher than the curve representing the deformation force $F_3$ (the "cold tensile curve"). Therefore, when the memory element is heated, an effective force of $F_2$ minus $F_3$ remains. This is the net force acting to return the memory metal to its stable shape. In the case of a memory metal element having a measurable length, the difference between the deformed length of the memory metal when it is cold and length of the memory metal when it is hot is referred to as the stroke. When the stroke of the memory element (spring) ranges from C to B, the amount of work, done by the memory element, is represented by the surface area described between the hot and cold tensile curves. The amount of work will be $(F_2-F_3)\times(\epsilon_C-\epsilon_B)$ and this can be used to cause a movement with a certain force. Thus, memory metal is an energy converter. It transforms heat directly into mechanical energy.

Previous attempts have been made to use temperature sensitive materials in actuators. An example is the temperature responsive ventilator disclosed in U.S. Pat. No. 3,436,016 to louvers or shutters associated with the frame for closing the framed area in one position and opening the framed area in another position. A temperature-responsive spring is connected to the louvers or shutters. In response to temperature changes, the spring positions the shutters or louvers between the opened and closed positions.

U.S. Pat. No. 4,497,241 to Ohkata discloses a device for automatically adjusting the angle of a louver. The device includes a memory metal spring for applying a rotary force to the louver in one direction and a bias spring for applying a rotary force louver in the opposite direction. The position of the louvers is determined by the balance between the memory metal spring and the bias spring. When the air is cold, the memory metal spring is deformed by the bias spring. Conversely, when the air is warm the memory metal spring returns to its memorized position against the bias spring, and the louver rotates to a position aligned with the passage. In this way, the louver is automatically controlled in response to the temperature of the diffused air.

All of the devices disclosed in the various embodiments of the Ohkata patent include a counterbalancing spring 6, which does not have a constant spring force; consequently, the spring provides an increasingly strong resistance force as it is biased. As disclosed in greater detail below, the present inventors have discovered that the use of a spring which does not have a characteristic with a constant force can severely limit the stroke of the actuator and thus limit the usefulness of the actuator itself.

SUMMARY OF THE INVENTION

The present invention relates to a temperature responsive actuator which provides a near constant force in response to heat. The heat can be provided by electricity or solar means or any other hot medium. The actuator includes a memory metal spring element, a constant or substantially constant force spring element and an actuated element. The memory metal spring element undergoes a predetermined deformation in response to the force of the constant force spring element at lower temperatures and returns to its original shape against the bias of the constant force spring element when the temperature of the memory metal exceeds the transformation temperature. The predetermined constant or substantially constant spring force which acts in opposition to the force applied by the memory metal spring is selected to be less than the force required to deform the memory metal at high temperatures (the austenitic structure) and greater than the force needed to deform the memory metal spring at low temperatures (martensitic structure). Thus, the spring force is sufficient to deform the memory metal martensite structure, but not strong enough to prevent the memory metal from returning (shrinking) to its stable state when heated. The actuated element is connected to the memory metal element so as to move with the memory metal spring in response to and against the constant tension spring.

The actuated element can be virtually any element for which a linear stroke resulting from a temperature change is useful. For instance, the actuated element can be the control element for a venetian blind. Because the linear stroke can be converted into any other useful mechanical movement such as rotation and oscillation using known devices, it is expected that there will be many such uses.

The memory metal actuators of the present invention have a much greater stroke than known memory metal actuators because the counteracting element or spring used has a flat or substantially flat characteristic, i.e., a constant force, or a characteristic which is only slightly inclined. The counteracting element operates like a constant load or dead weight and, provided the force is properly selected, makes it possible to obtain 100% of the stroke available. In contrast, when, as in the prior art, a counteracting element which has a sharply inclining characteristic is used, the stroke of the actuator is greatly reduced (i.e., only a fraction of the available stroke is utilized). Further, the force applied by the actuators using a spring with a sharply inclining characteristic varies throughout the stroke i.e., is not constant.

In accordance with another aspect of the present invention, a substantially flat characteristic can be provided by a counteracting element with an inclining characteristic if the rate of incline is sufficiently small to allow full utilization of the available stroke. In physical terms, this requires a very long spring so that the spring is only slightly deflected during the stroke.

While satisfactory results can be obtained with a spring having a flattened characteristic, the best results are obtained when the counteracting element provides an entirely flat characteristic The present invention provides such a construction and includes two drums, a strip, and a wire. The strip has a concave shape perpendicular to longitudinal axis of the strip and is stored on a first drum. The end of the strip is attached to a second drum in such a way that when the strip unrolls from the first drum, it rolls up on the second drum in the opposite direction. A wire stored on the drum is attached to the memory element spring or wire and exerts the counteracting force. This construction has the advantage that the force exerted by the counteracting element remains constant over the entire length of the strip when it unrolls from the first drum to the second drum, or vice versa. The counteracting element force is constant in spite of the changing diameter of the stored quantity of the strip.

DETAILED DESCRIPTION

Figure 4:
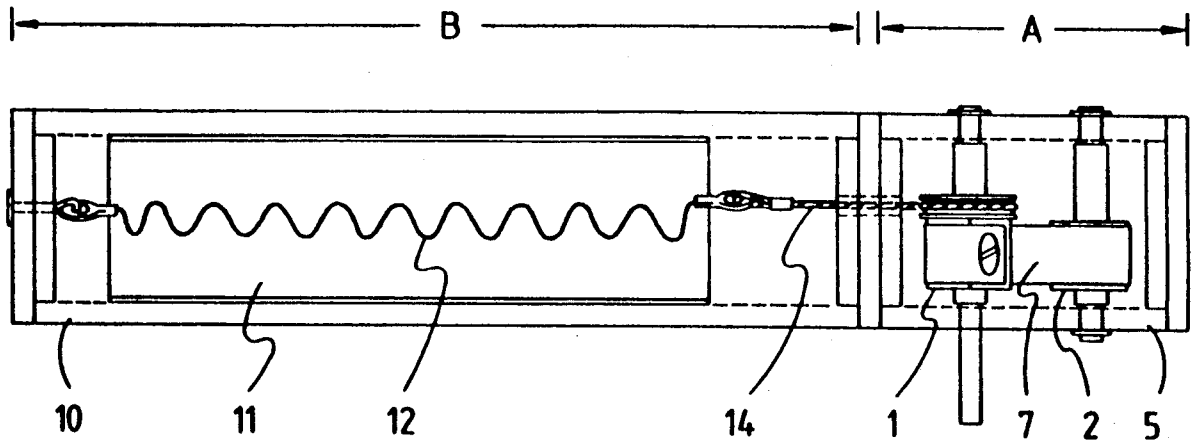
FIG. 4 is a schematic top view of an actuator according to the present invention.
Figure 5:
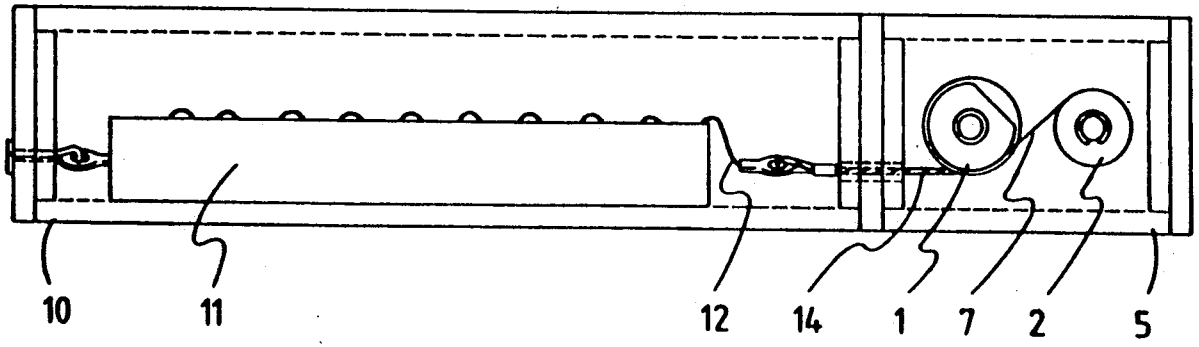
FIG. 5 is a side view of the actuator of FIG. 4.

FIGS. 4 and 5 show an embodiment of the actuator of the present invention. The actuator is designed to provide an automotive force in response to heat. The heat may be provided by either electricity or solar means or any other hot medium. The basic components of the actuator are a memory metal assembly B and a constant tension spring assembly A.

The constant spring assembly portion A includes a spring strip 7 which is attached to two freely rotatable drums 1 and 2, a housing 5 and a steel wire 14 attached to the first drum 1. The spring strip 7 has a concave shape perpendicular to the longitudinal axis of the drum. The strip is connected to the second drum 2 in such a way that when the strip unrolls from the first drum 1 it rolls up on the second drum 2 in the opposite direction. The wire 14 is also connected to the first drum 1 and is attached to a memory metal element 12 (in this case a spring) to transfer forces between the memory metal element and the constant tension spring assembly. Thus, a constant force is applied to the memory element 12 over the entire length of the strip when it unrolls from drum 1 to drum 2 or vice versa.

It should be noted that the memory metal element can have any shape and is not restricted to a coiled spring shape. For example, the memory metal element can also be constructed as a straight tension wire (with a linear movement) or as a torsion wire or rod (with a rotational movement).

The memory metal assembly portion B can be constructed from a clear-transparent material like glass, acrylic, polycarbonate or in a black anodized aluminum tubing. The housing 10 should have an inside diameter which is not less than the outside diameter of the memory metal element 12 and the spring and/or wire 14 in its shortest form. The housing 10 of the memory metal portion B can be a continuation of the housing 5 of the constant tension spring portion A or it can be a separate housing.

As shown particularly well in FIG. 4, the shaft upon which the first drum 1 rotates is extended through the housing 5 a sufficient distance to allow attachment of gears, pinions and the like for the purpose of driving other mechanisms for converting of mechanical movement. The actuator of FIGS. 4 and 5 shows one example of how the linear movement of the actuator may be converted to a rotary motion. There are of course, other ways of achieving this.

The constant tension provided by the spring 7 is selected to provide a force which exceeds the tensile force of the memory metal element 12 when the memory metal is cold, but is less than the tensile strength of the memory metal element when the memory metal is hot, preferably about halfway between these two levels. Thus, when the memory metal element is heated, by electricity or the ambient temperature rise (e.g., resulting from solar energy), the tensile force of the memory metal increases to a point where it exceeds the constant tension provided by the spring. The actuator then.

moves in response to the force of the memory metal element 12 against the constant tension of the spring 7. In this way, the memory metal acts as a mechanical energy converter, converting heat energy directly into mechanical movement. The use of a constant tension spring (as opposed to a spring with an inclining characteristic) is important because it significantly increases the length of the actuator stroke, and because it allows the actuator to provide constant force. When solar energy is to be used to heat the memory metal element 12, a mirror such as concave mirror 11 can be used to focus solar energy on the memory metal element.

An actuator using an ordinary spiral spring such as that used in the prior art will have a much shorter stroke than an actuator in which a substantially constant force spring is used. In the former, the effective force of the elements, or the length of the stroke, will not be constant.

Figure 1:
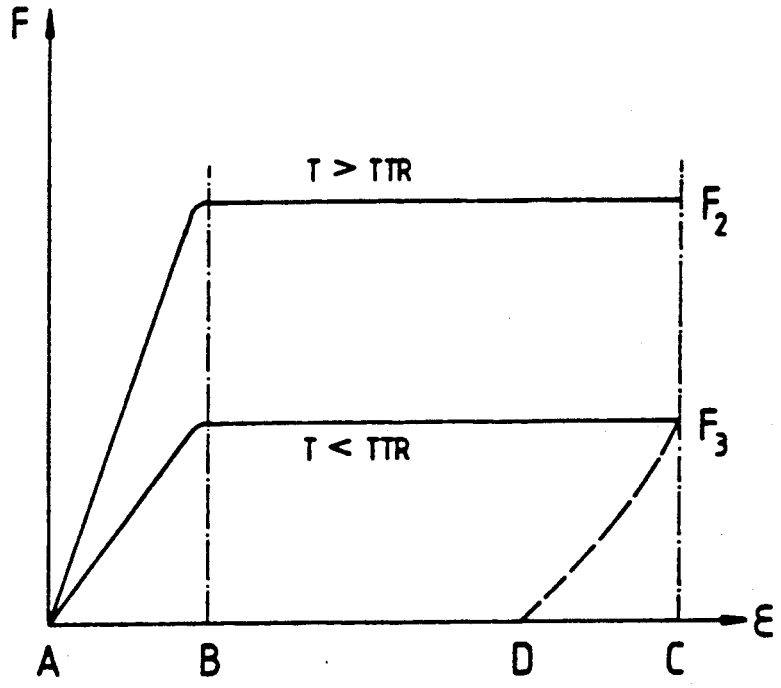
FIG. 1 is a stress strain curve for a known memory metal.
Figure 2:
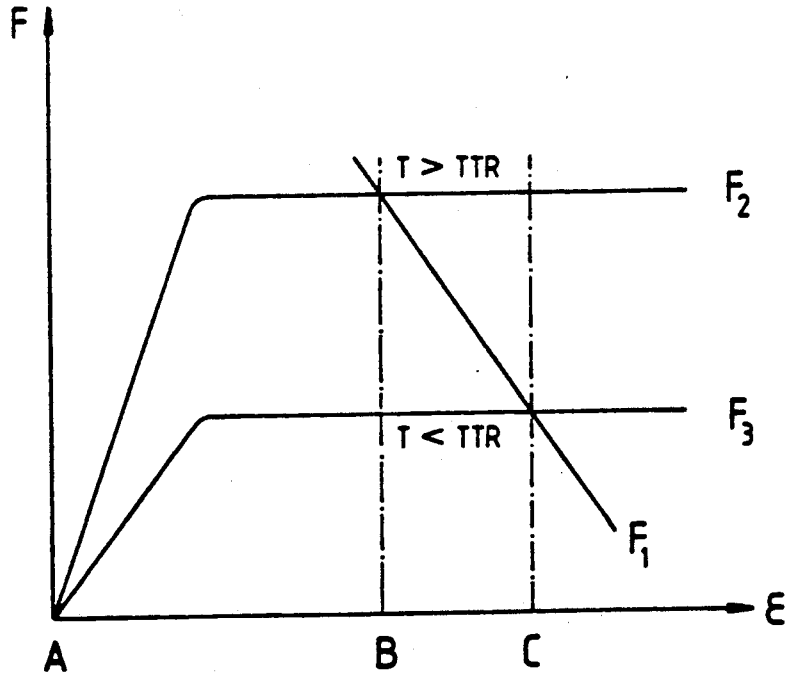
FIG. 2 is a stress strain curve for a memory metal and a counteracting element with a sharply inclining characteristic.
Figure 3A:
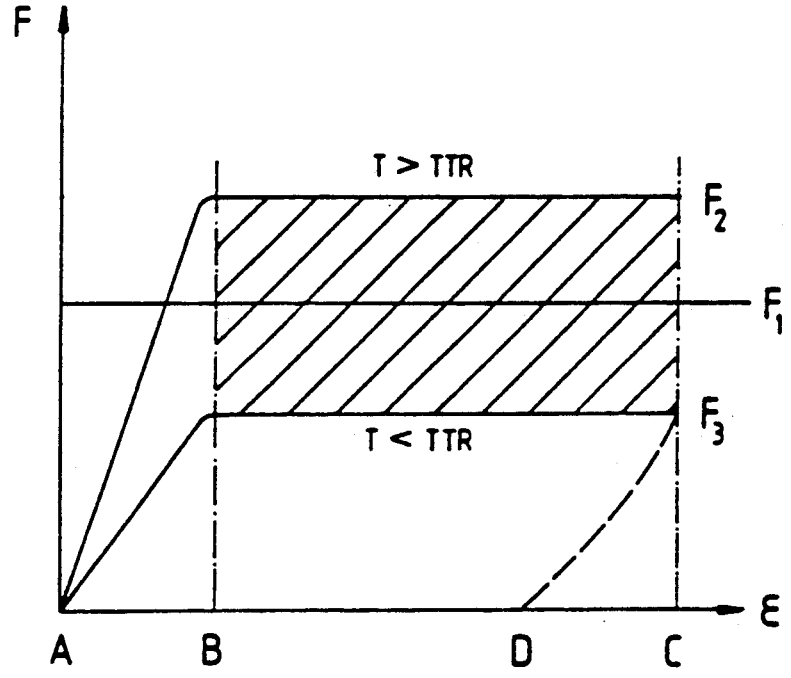
FIG. 3A is a stress strain curve for an actuator according to the present invention.

Specifically, with reference to FIG. 2, the stroke BC of the elements (springs) achieved when an ordinary spiral spring having an inclining characteristic is used as a counteracting force is much shorter than the stroke of the elements achieved when a constant force spring with a flat characteristic is used as a counteracting force (FIG. 3A). This is because at a temperature above TTR, when the memory element returns to its stable shape and stretches the counteracting spring, the movement (recovery) of the memory element in FIG. 2 will stop at point B where $F_1$ is equal to $F_2$. The effective force of the memory element at point B in FIG. 2 equals zero. Further, at a temperature beneath TTR, when the memory element is stretched by the counteracting spring, the movement of the counteracting spring in FIG. 2 will stop at a point C, where $F_1$ is equal to $F_3$. The effective force of the counteracting spring in FIG. 2 at point A is equal to zero. In fact, the effective stroke in FIG. 2 will be even shorter than shown because the elements (springs) also have to overcome a certain amount of friction in the mechanism.

The effective power of the elements $(F_2-F_1)$ or $(F_1-F_3)$ in FIG. 2, when an ordinary spring with an inclining characteristic is applied, is not constant. Furthermore, the effective force over the entire length of the stroke BC is not sufficient to cause movement. Sufficient effective force will only be achieved in the middle of the area between the hot tensile curve and the cold tensile curve.

The present inventors have discovered that the disadvantages of using a spring having an inclined characteristic can be obviated through the use of a constant force spring as a counteracting element. Specifically, with reference to FIG. 3A, the use of a constant force spring arrangement maximizes the effective stroke of the actuator and results in an actuator which produces a constant, effective force over the length of the stroke. The effective force of the memory element at a temperature above TTR is the difference between the hot tensile curve $F_2$ and the curve representing the constant force spring $F_1$. The effective force of the counteracting element at a temperature beneath TTR is the difference between the curve, representing the constant force spring $F_1$ and the cold tensile curve $F_3$, that is, $F_1$ minus $F_3$. Thus, when a counteracting element with a flat characteristic is applied, the actuator is able to execute two counteracting movements with a maximum effective force over maximum stroke.

In order to provide a counteracting element having a substantially, though not entirely flat characteristic, one can use a long, slack spiral spring which is preloaded or prestretched. By this construction, only a small part of the characteristic will be used. However, the application of such slack, preloaded spiral has the disadvantage that it will be very long. Further, the characteristic of the spring will not be ideally flat, compared with the characteristic of a constant load.

Figure 6:
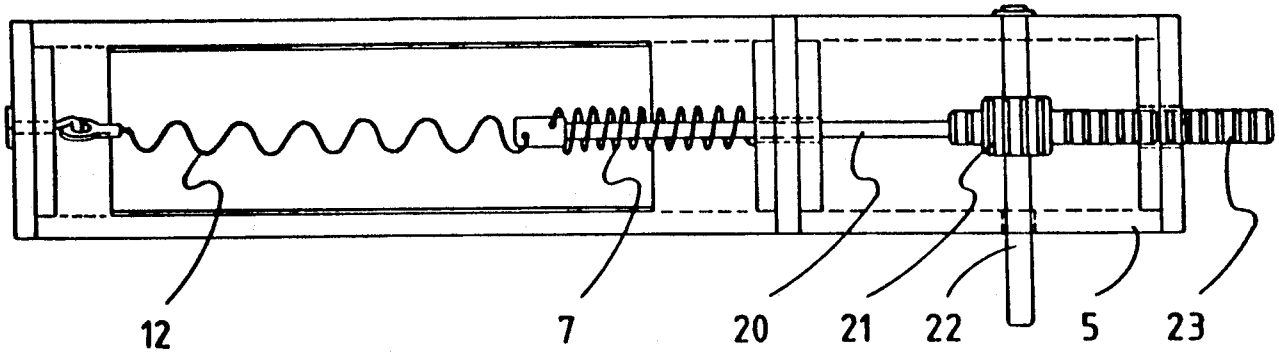
FIG. 6 is a schematic top view of a second actuator according to the present invention.

FIG. 6 shows a second embodiment of the actuator of the present invention in which the memory metal element 12 has a spring-like form and is connected at one end to an output rod 20. A spring 7 is also connected to the rod 20 and acts in the opposite direction. The spring 7 in this case does not apply constant force to the rod 20 in opposition to the force applied by the memory metal. However, the spring 7 is sufficiently long such that only a small portion of its spring characteristic comes into play in opposing the force of the memory metal spring 12. Consequently, as discussed above, the incline of the spring characteristic is sufficiently flat to enable utilization of the entire stroke available. The rod 20 is moved linearly as a result of the balance between the memory metal element 12 and the opposing spring 7. As explained above, this balance depends on the temperature of the memory metal element 12. A rack element 23 is integral with or secured to the rod 20 for linear movement therewith. The rack includes spaced teeth as is known. A shaft 22 is rotatably mounted in the housing 5. A pinion 21 is formed on or rotatably secured to the shaft 22. The teeth of the pinion 21 engage with the teeth of the rack 23 such that upon linear movement of the rack 23, the pinion 21, and consequently the shaft 22, rotate.

Figure 7:
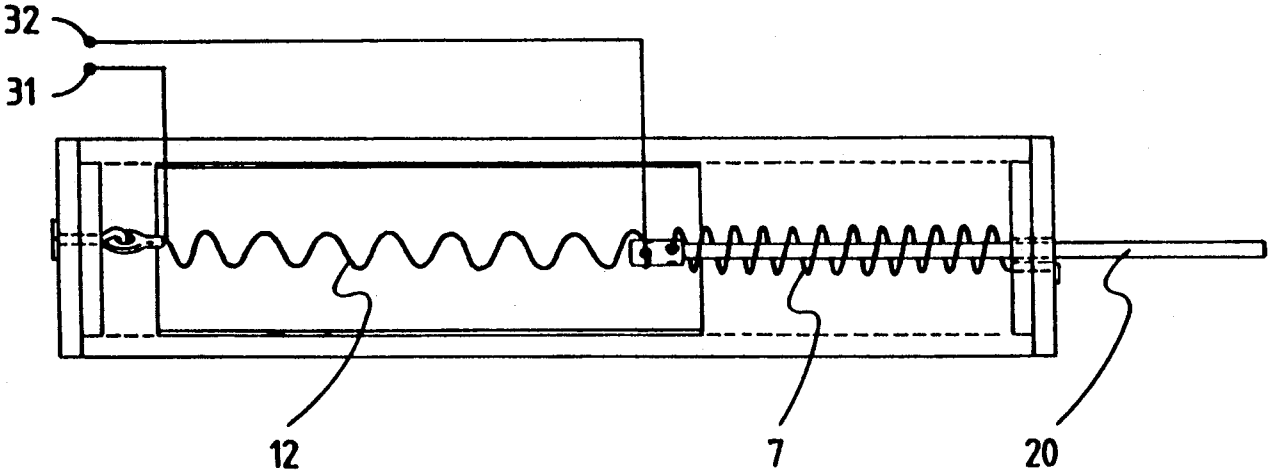
FIG. 7 is a schematic top view of a third actuator according to the present invention.

FIG. 7 shows another embodiment of the present invention. This embodiment is similar to that of FIG. 6, except that in this case no mechanism is provided for converting the linear movement of the shaft 20 into rotary movement. Such an actuator provides linear reciprocation for use where such movement in response to temperature changes is desirable. Naturally, any known mechanical transmission device may be connected to the linearly reciprocating shaft for respectively using the reciprocating movement directly or converting the linear reciprocation into any desired movement.

FIG. 7 also illustrates the connection of electrical leads 31 and 32 to the memory metal element 12. The provision of leads 31 and 32 make it possible to electrically heat the memory metal element instead of, or in addition to, using solar heat. The amount of current required to cause the memory metal element to transform depends on the thickness of the memory metal element.

Figure 8:
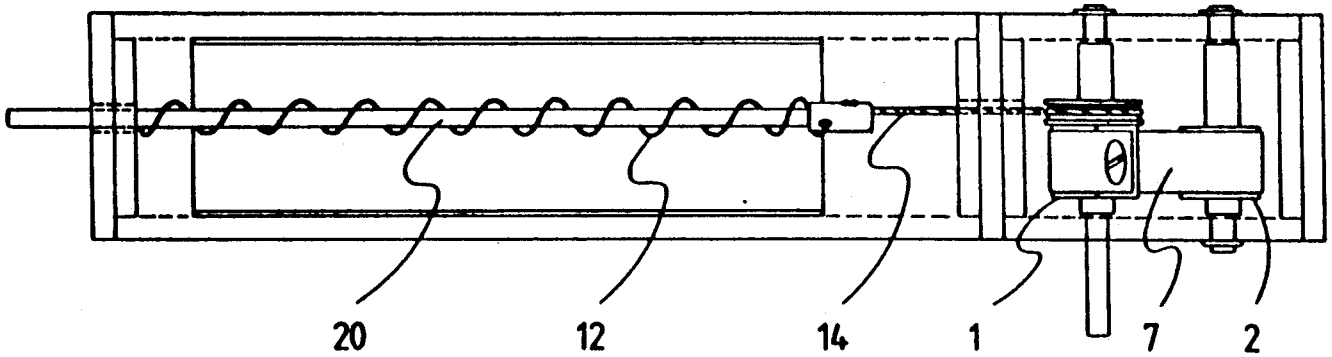
FIG. 8 is a schematic top view of a fourth actuator according to the present invention.

FIG. 8 shows another embodiment of the present invention. This embodiment is similar to FIG. 7 except that the spring 7 is a constant tension spring of the type described above in connection with FIGS. 4 and 5. The constant tension force of the spring assembly opposes the force of the memory metal element 12 through a steel wire or the like 14. Like the embodiment of FIG. 7, the embodiment of FIG. 8 does not include a mechanism for converting the linear reciprocation of the rod 20 to some other desired motion. Of course, such a device could be provided if desirable.

Figure 9:
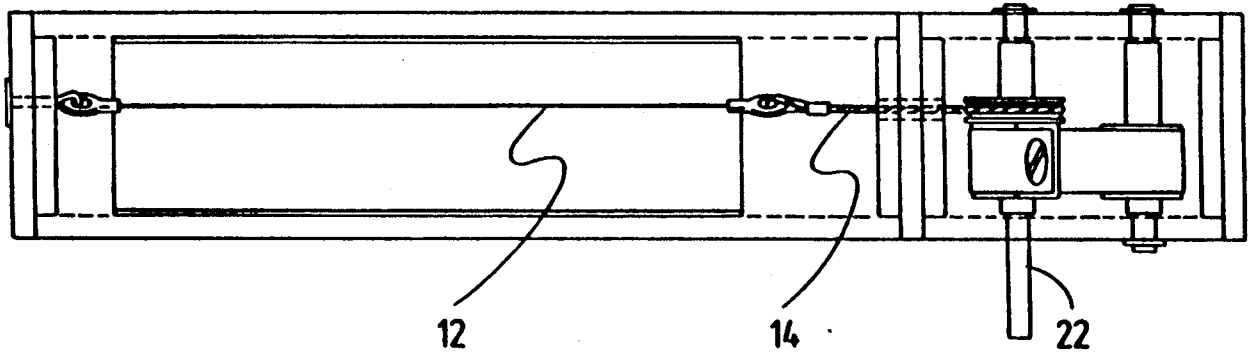
FIG. 9 is a schematic top view of a fifth actuator according to the present invention.

FIG. 9 shows another embodiment of the present invention. This embodiment is similar to that of FIG. 4 except that the memory metal element 12 is a straight tension wire rather than a coiled spring. The change in length of the straight wire resulting from transformation is less than that of a coiled spring of similar length. Consequently, a longer wire must be used to obtain the same change in length.

Figure 3B:
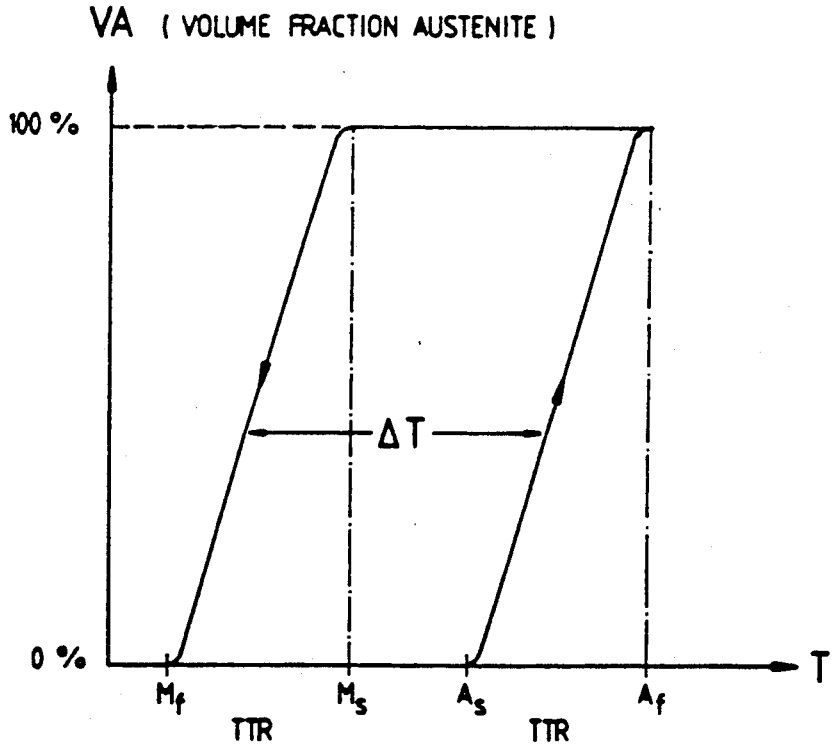
FIG. 3B is a diagram illustrating the temperature hysteresis of the actuator of the present invention.

It should be noted that the mechanism of the present invention is relatively insensitive to short temperature fluctuations because the martensitic transition as noted above takes place with a certain hysteresis or lagging. Specifically, with reference to FIG. 3B, when the memory element is heated, it transforms to austenite. The transformation ranges from $A_s$ (start) to $A_f$ (finish) of the transformation. When the memory element is cooled, it transforms to martensite. The transformation ranges from $M_s$ to $M_f$. The range $A_sA_f$ lies much higher (in temperature) than range $M_sM_f$. Consequently, the response of the memory element to temperature fluctuations can take place with a certain delay.

The actuator of the present invention can be used to open and close roller curtains and all types of venetian-type panel curtains, horizontally as well as vertically, by either direct sunlight or, if so desired, by running an electric current through the spring and/or wire creating heat. When the force is created by electricity, proper insulation of the spring and/or wire from the aluminum tubing is required. The actuator can also be used for creating automatic movement in response to any predetermined temperature change of the medium in which the actuator is placed. Of course, there are other uses for the actuator.

Figure 10:
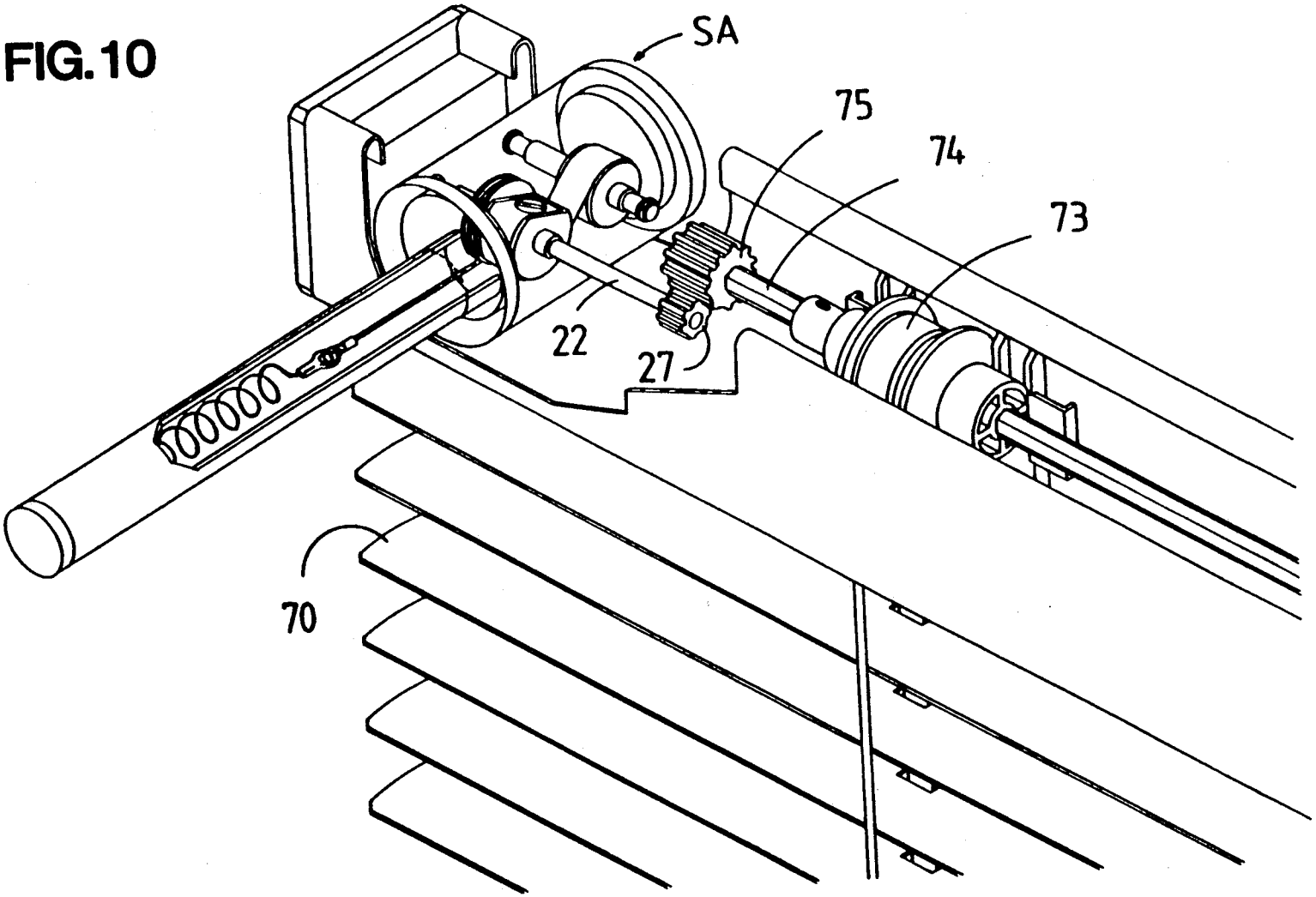
FIG. 10 is a perspective view of an actuator connected to a venetian-type panel curtain assembly.

FIG. 10 shows a solar actuator SA according to the present invention connected to a venetian-type panel curtain assembly 70. The curtain assembly is of a known type which includes a rotating operator 73. A shaft 74 is rotatably attached to the operator 73 and includes at one end, a gear 75 rotatably secured thereto. The gear 75 meshes with a gear 27 rotatably secured to shaft 22 of the actuator. In this way, the rotating output of actuator shaft 22 is transmitted to the operator 7 to operate the curtain assembly 70 in the known manner.

We claim:

1. A temperature responsive actuator comprising:

a memory metal element, the memory metal element including memory metal which undergoes a predetermined transformation between a predetermined first structure and a predetermined second structure at a first predetermined temperature range and between the second structure and the first structure at a second predetermined temperature range:

a generally constant force spring element, the spring element being connected to the memory metal element so as to provide a generally constant deformation force to the memory metal element, the generally constant force provided by the spring element being selected to be less than the force required to deform the memory metal element at temperatures above the predetermined temperatures and greater than the force required to deform the memory metal element at temperatures below the predetermined temperatures, such that the spring element deforms the memory metal element at a temperature below the predetermined temperature range and the memory metal element returns to its undeformed state against the bias of the spring element at temperatures above the predetermined temperature; and an actuated element connected to one of the memory metal element and the generally constant force spring element for movement in response to the change of shape of the memory metal element resulting from transformation of the memory metal between states.

2. The actuator of claim 1, wherein the actuated element is a control element for a venetian blind.

3. The actuator of claim 1, further comprising a mechanical movement device operably connected to said actuated element for converting said movement of the actuated element into a different type of movement.

4. The actuator of claim 3, wherein the mechanical movement device comprises a rack and pinion device.

5. The actuator of claim 3, wherein the mechanical movement device comprises a wire and drum, the wire having one end connected to the memory metal element and another end wrapped around and connected to the drum such that linear movement of the end of the wire connected to the memory metal element is converted into rotation of the drum.

6. A memory metal actuator for actuating a component in response to temperature change, the memory metal actuator comprising:

a memory metal element, the memory metal element being deformable between first and second predetermined shapes in response to temperature changes;

a generally constant force spring assembly, the constant force spring assembly comprising a first drum, a second drum, a strip stored on the first drum, the strip having an end attached to the second drum in such a way that when the strip unrolls from the first drum, it rolls upon the second drum, a wire stored on the drum attached to the memory metal element so as to apply a counteracting force to the memory metal element; and an actuated element, the actuated element being connected to one of the memory metal element and the generally constant force spring assembly for movement in response to changes in the balance of forces between the memory metal and the generally constant force spring assembly.

7. The actuator of claim 6, wherein the actuated element is a control element for a venetian blind.

8. The actuator of claim 6, further comprising a mechanical movement device for converting the movement of the actuated element into a different type of movement.

9. The actuator of claim 8, wherein the mechanical movement device comprises a rack and pinion device.

10. The actuator of claim 8, wherein the mechanical movement device comprises a wire and a drum, the wire having one end connected to the memory metal element and another end wrapped around and connected to the drum such that linear movement of the end of the wire connected to the memory metal element is converted into rotation of the drum.

11. A temperature responsive actuator comprising:

a housing;

a memory metal element comprising a coiled spring located within the housing, the memory metal element having a composition such that the memory metal transforms from a martensite structure to an austenitic structure through a transformation range in response to a known increase in temperature;

a counteracting spring arranged within the housing and connected to the memory metal element at a point of connection so as to provide a force which is sufficient to deform the memory metal element in its martensitic state but insufficient to deform the memory metal in its austenitic state throughout the transformation range, such that when the memory metal is transformed from its martensitic state to its authentic state, the memory metal element shrinks and the point of connection moves during the transformation; and an actuated element connected to one of the memory metal element and the counteracting spring such that the actuated element moves when the point of connection moves.

12. The actuator of claim 1, wherein the memory metal is a nickel titanium alloy.

13. The actuator of claim 1, further comprising a controlled electrical heater for heating the memory metal element to cause actuation of the actuated element.

14. The actuator of claim 11, wherein the actuated element is a control element for a venetian blind.

15. The actuator of claim 11, further comprising a mechanical movement device for converting movement of the actuated element into a different type of movement.

16. The actuator of claim 15, wherein the mechanical movement device comprises a rack and pinion device.

17. The actuator of claim 15, wherein the mechanical movement device comprises a wire and a drum, the wire having one end connected to the memory metal element and another end wrapped around and connected to the drum such that linear movement of the end of the wire connected to the memory metal element is converted into rotation of the drum.

18. The actuator of claim 1, wherein the memory metal element is a straight tension wire.

19. The actuator of claim 1, wherein the memory metal element is a coiled spring.

20. The actuator of claim 11, wherein the counteracting spring is a contestant force spring element.

* * * * *